US008640719B2

(12) United States Patent
Gmeiner

(10) Patent No.: US 8,640,719 B2
(45) Date of Patent: Feb. 4, 2014

(54) BOTTLE CLEANING MACHINE

(75) Inventor: Franz Gmeiner, Sinzing Ortsteil Eilsbrunn (DE)

(73) Assignee: Krones AG, Neutraubling (DE)

( * ) Notice: Subject to any disclaimer, the term of this patent is extended or adjusted under 35 U.S.C. 154(b) by 513 days.

(21) Appl. No.: 12/702,538

(22) Filed: Feb. 9, 2010

(65) Prior Publication Data

US 2010/0200020 A1 Aug. 12, 2010

(30) Foreign Application Priority Data

Feb. 12, 2009 (DE) ..... 10 2009 008 724

(51) Int. Cl.
*B08B 3/00* (2006.01)

(52) U.S. Cl.
USPC .... 134/137; 134/132; 134/166 R; 134/167 R; 134/172; 134/198

(58) Field of Classification Search
None
See application file for complete search history.

(56) References Cited

U.S. PATENT DOCUMENTS

| | | | | |
|---|---|---|---|---|
| 2,011,786 A | | 8/1935 | Walker | |
| 3,546,816 A | * | 12/1970 | Enegren | 451/86 |
| 3,556,847 A | | 1/1971 | Prodzenski | |
| 3,854,445 A | | 12/1974 | Stolle et al. | |
| 4,104,081 A | * | 8/1978 | Totten | 134/23 |
| 4,577,651 A | | 3/1986 | Murtz | |
| 5,285,801 A | * | 2/1994 | Klenk | 134/73 |

FOREIGN PATENT DOCUMENTS

| | | | |
|---|---|---|---|
| DE | 1532515 | A1 | 1/1970 |
| DE | 2844126 | A1 | 4/1979 |
| DE | 20111419 | U1 | 10/2001 |
| EP | 0501302 | A1 | 9/1992 |
| EP | 0529387 | A1 | 3/1993 |
| EP | 1160019 | A1 | 12/2001 |
| FR | 444658 | A | 10/1912 |
| FR | 1114257 | A | 4/1956 |

OTHER PUBLICATIONS

German Search Report for DE 10 2009 008 724.9.
European Search Report for EP 10152782, dated May 10, 2010.

* cited by examiner

*Primary Examiner* — Eric Golightly
(74) *Attorney, Agent, or Firm* — Marshall, Gerstein & Borun LLP

(57) ABSTRACT

A bottle cleaning machine and to a method for cleaning bottles with a bottle transporting device for transporting the bottles to be cleaned and with spraying nozzles. The bottle transporting device is configured such that the bottles are transported past the spraying nozzles along a substantially spiral transportation path, and preferably about a horizontal axis.

13 Claims, 6 Drawing Sheets

BOTTLE CLEANING MACHINE

CROSS-REFERENCE TO RELATED APPLICATION

The present application claims the benefit of priority of German Application No. 102009008724.9, filed Feb. 12, 2009. The entire text of the priority application is incorporated herein by reference in its entirety.

FIELD OF THE DISCLOSURE

The present disclosure relates to a bottle cleaning machine and to a method for cleaning bottles.

BACKGROUND

The classic bottle cleaning machines known from the prior art (e.g. LAVATEC of the company KRONES, the assignee of the present application) move the bottles in bottle containers, which are arranged in a row on crossbars, through the different caustic baths. FIG. 6 shows, for instance, the sections that are arranged one after the other and through which a bottle is passed to be cleaned. The caustic baths must have a certain volume to achieve the corresponding treatment times and adequate cleaning. The large volume, however, means a lot of chemicals, a lot of energy for heating and for maintaining the temperature of the cleaning liquid, and a sturdy construction for carrying the weight.

SUMMARY OF THE DISCLOSURE

Starting therefrom, it is the object of the present disclosure to provide a simplified bottle cleaning machine and a simplified method for cleaning bottles, which permit a more efficient, more eco-friendly and less expensive cleaning operation.

In contrast to the prior at the bottles to be cleaned are no longer passed through caustic immersion baths, but are transported along a substantially spiral transportation path past the spraying nozzles. Spiral substantially means here that spiral need not be an exactly mathematical spiral, but that the transportation path is winding around a central axis. Since the bottles are transported in spiral form past the spraying nozzles, the bottles can be cleaned intensively in a mechanical way by means of the spraying nozzles. This intensive mechanical cleaning saves cycle time, energy and water. In comparison with the prior art a substantially smaller amount of caustic solution is needed. The smaller caustic amount entails the following advantages:

- a lot of weight is saved, resulting in less "steel and iron";
- less heating energy and easier temperature control (instantaneous water heater),
- less infeed time, and
- less chemicals and waste water.

The reduced weight of the machine thus no longer requires heavy-load transportation and it facilitates the installation at the customer's place. Preferably, the spiral transportation path extends around a horizontal axis. This entails the advantage that the bottles in their spiral movement can also be emptied again at any time. Transporting device stands here for the device that holds and conveys the bottles along the transportation path and comprises a bottle mount, a correspondingly extending guide and a drive.

Advantageously, the bottle cleaning machine comprises a housing with at least one collecting tub. The housing serves as a protection, particularly as an anti-splash protection, to the outside. In the at least one collecting tub, cleaning liquid can be collected and returned again for cleaning purposes.

The spraying nozzles can be arranged outside and/or inside the substantially spiral transportation path. The spraying nozzles can be arranged to be stationary. It is also possible that particularly the spraying nozzles arranged inside the transportation path are rotatingly arranged, particularly on a nozzle wheel. When the spraying nozzles, for instance, are rotating in synchronism with the transportation movement of the bottles, a particularly efficient and reliable internal cleaning can be ensured. The spraying nozzles can be arranged on a nozzle wheel in a particularly simple way, the axle of said wheel being preferably rotated about the pitch angle of the spiral relative to the horizontal axis L.

It is advantageous when at least in a spiral winding of the transportation path a portion is configured as a circular arc, especially as a 150°-200° circular arc. This guarantees that the cleaning jet, e.g. from the nozzles on the nozzle wheel, will always centrically impinge into the bottles or bottle baskets, respectively. To this end the upper portion of the spiral is then configured as a circular arc. While the bottles are filled, an analogous process is possible with a lower portion of the transportation path.

Advantageously, a tub is arranged in front of the spiral transportation path which the bottles are transported through. In the tub, the presoaking process can be carried out, for instance, with the help of spraying heads.

According to a preferred embodiment the bottles are transported in bottle holders, particularly grated bottle baskets which are connected to each other to form a room-traveling chain. Hence, the bottles can be guided in transportation direction one after the other along the spiral transportation path and can also be conveyed overhead. The mouthpiece of the bottle can be centered in the middle by way of the bottle holders.

To ensure an excellent cleaning operation, at least some of the spraying nozzles are preferably configured as high-pressure nozzles. The cleaning liquid can be ejected particularly in the form of a pulsed jet and/or may have compressed air added to it. Hence, a particularly thorough cleaning action can be achieved.

It is also possible that according to a preferred embodiment the bottle cleaning machine further comprises a device for generating a cleaned air current in the housing from the clean side to the dirt side. The introduced air current from the clean side to the dirt side can counteract bacterial dissemination.

Advantageously, the bottle cleaning machine has a modular structure consisting of a plurality of individual modules, wherein each individual module comprises a spiral bottle transporting device, spraying nozzles and at least one collecting tub. Hence, the bottle cleaning machine can be adapted to different requirements in that different individual modules are arranged side by side. Since in all cleaning sections the same subassemblies are used and since the housing can also be divided into standard transportation sizes, the machine can be produced at low costs. With the standard modules the machine can be configured in conformity with performance demands and cleaning requirements. In the assembled state of the modules, the collecting tubs are preferably separated from one another, so that the cleaning liquid which in specific cleaning sections is running into the corresponding collecting tubs can be returned separately to a specific cleaning section. The cleaning liquid is here supplied from the at least one collecting tub via at least one filter and a pump to specific spraying nozzles of a cleaning section or a specific module again.

BRIEF DESCRIPTION OF THE DRAWINGS

The present disclosure will now be explained with reference to the following figures in more detail.

DETAILED DESCRIPTION OF THE PREFERRED EMBODIMENT

Figure 1:
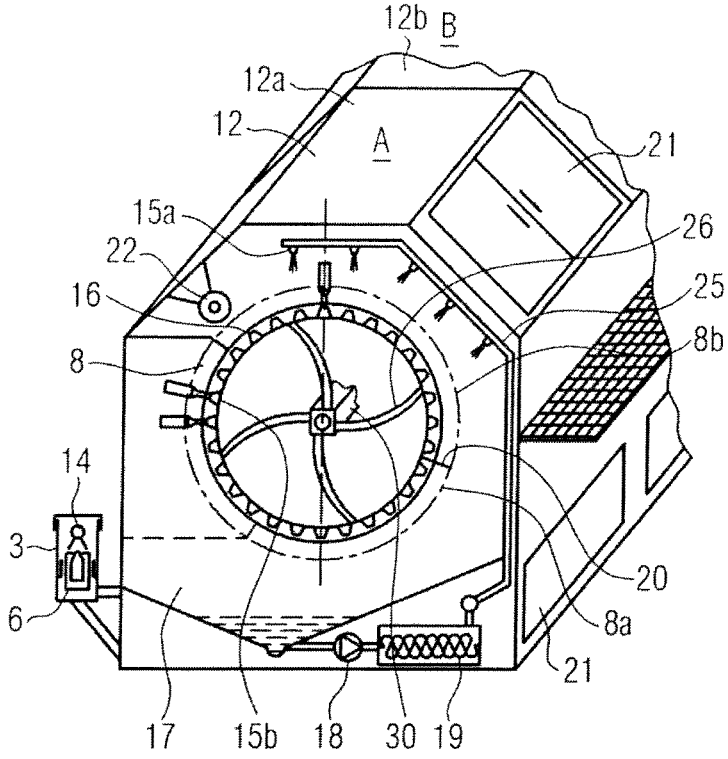
FIG. 1 is a perspective view showing a section of a bottle cleaning machine according to the present disclosure.
Figure 2:
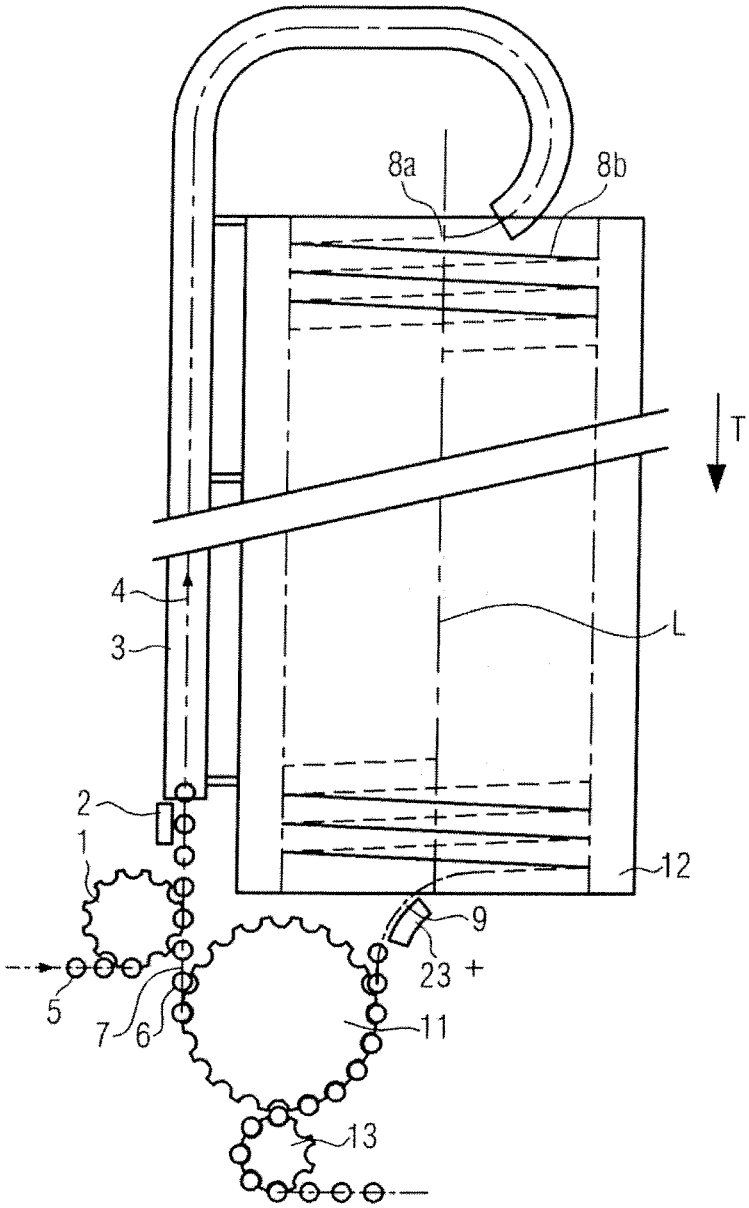
FIG. 2 is a schematic view showing across-section through a bottle cleaning machine according to the present disclosure.
Figure 4A:
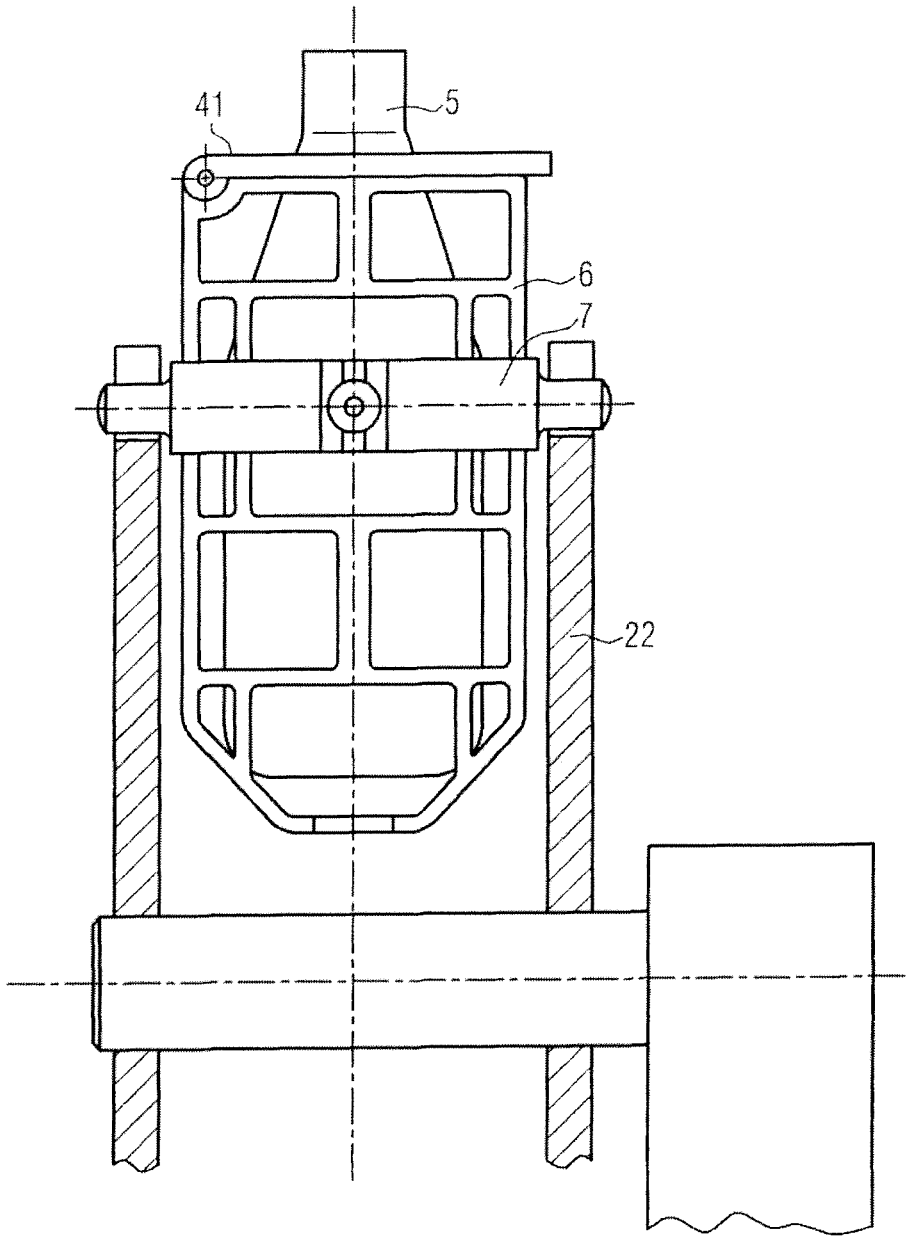
FIG. 4*a* is a schematic view showing a longitudinal section through a bottle holder with bottle basket and drive.
Figure 4B:
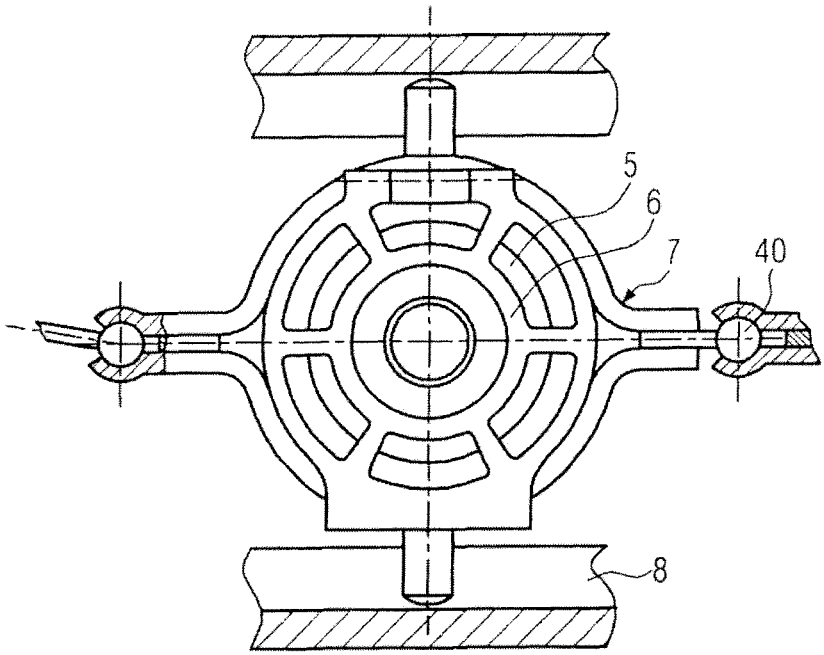
FIG. 4*b* is a schematic top view on the room-traveling chain with bottle basket and spiral guide.

FIG. 1 is a schematic illustration showing a section of a bottle cleaning machine according to the present disclosure. FIG. 2 shows across section through the bottle cleaning machine 10 according to the disclosure. The bottle cleaning machine 10 comprises a bottle transporting device for transporting the bottles 5 to be cleaned, which device is configured such that the bottles 5 are transported past spraying nozzles 15*a, b* along a substantially spiral transportation path. The bottles 5 are here held with bottle holders 6 so that the bottles can also be moved overhead and the mouthpiece of the bottle is centered in the middle. The bottle holders are interconnected via a corresponding joint 40 (FIG. 4*b*) to form a room-traveling chain 7. Especially the bottle baskets 6 as shown in FIGS. 4*a*, 4*b* are suited as bottle holders.

The bottles 5 are accommodated in the bottle baskets 6 and are retained e.g. via a pivotable basket lid 41, through which the bottle neck projects for example outwards. The lid 41 remains firmly closed during transportation.

The bottle holders 6 are running in the bottle cleaning machine 10 in corresponding guides and are driven via several electronically synchronized electric drives 22 that can ensure that the chain cannot get tightened despite the large number of loops. Strictly speaking, spiral transportation path 8 is here not a mathematical spiral, but just means that the transportation path of the bottles winds around an axis L.

The bottle cleaning machine comprises a housing 12, with at least one collecting tub 17 collecting the cleaning liquid. Spraying nozzles 15*a, b* are here arranged outside and inside the substantially spiral transportation path 8. The bottles are here moved along their transportation path past the spraying nozzles 15*a, b* and can be cleaned by the jet of the spraying nozzles mechanically from the inside and from the outside. Advantageously, the spraying nozzles 15*a, b* are configured as high-pressure nozzles that are operated in pulsed fashion for improving the cleaning action and/or eject a jet having compressed air added thereto. In this embodiment the spraying nozzles 15*a* that are arranged outside the spiral transportation path 8 are mounted to be stationary. As shown in FIG. 1, the upper spraying nozzles 15*a* are here arranged in the upper portion on a spraying water line 25. The spraying nozzles 15*b*, which are arranged inside the spiral transportation path 8, are rotatingly arranged on a nozzle wheel 16. Preferably at least some spraying nozzles 15*b* are provided on a wheel 16, the number thereof corresponding to the number of the baskets in a 360° spiral. The spraying nozzles 15*b* can here co-rotate in synchronism with the transportation movement of the bottles. A corresponding nozzle wheel 16 can be co-rotated in a partitioned form, particularly via entraining brackets or means 20, if necessary e.g. by the transporting device, particularly on the chain 7 formed by the bottle holders. The spraying nozzles 15*b* are for instance supplied with cleaning liquid via spraying arm lines 26 from the hollow shaft 30.

Figure 3:
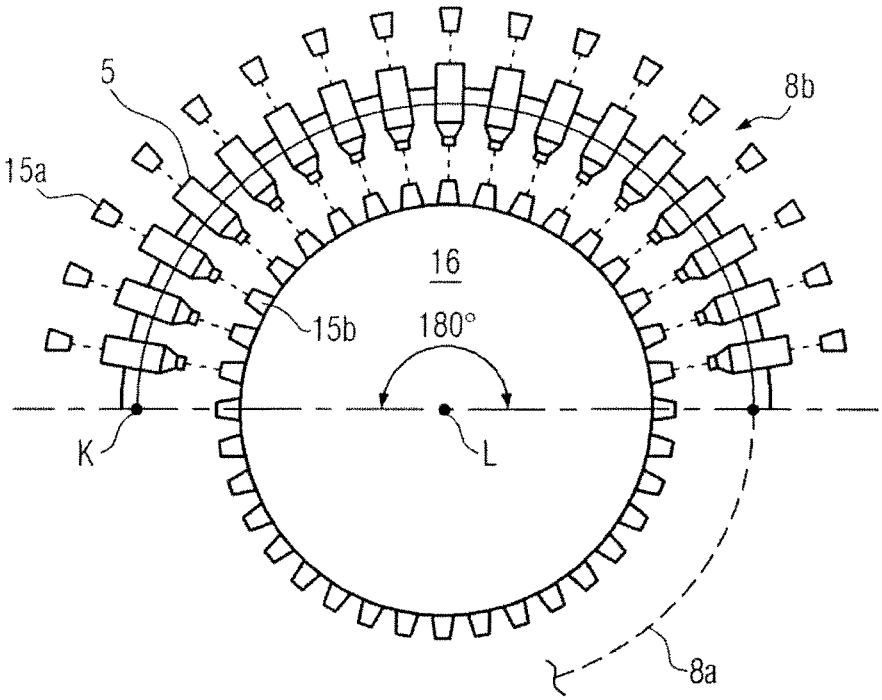
FIG. 3 is a schematic view showing a longitudinal section through the spiral transportation path to the bottles to be cleaned.

As follows particularly from FIG. 3, an upper portion 8*b* can then be formed as a 150°-200° circular arc in a spiral winding of the transportation path. In FIG. 3 the portion is configured as a 180° circular arc. It is thereby ensured that the cleaning jet from the nozzles 15*b* on the nozzle wheel always impinges centrally into the bottle baskets or bottle mouths.

The circular arc can here e.g. be located in a plane that is positioned in a direction perpendicular to the horizontal axis L, as shown in FIG. 3. The lower portion 8*a* of the spiral winding does then not extend in the same plane as the upper portion 8*b*, but extends in the direction of axis L rearwards to a point located in transportation direction T behind point K. Several spiral wheels can be arranged one after the other. It is also possible that the nozzle wheels are not positioned in a plane perpendicular to the horizontal axis L, but in a plane inclined obliquely relative to the horizontal axis L, wherein the spiral will then correspondingly rise in the portion in a direction oblique to the horizontal axis L, as shown e.g. in FIG. 2. Thus the axis of the nozzle wheel is then rotated by the pitch angle of the spiral relative to the horizontal axis. This means that FIG. 3 would then be a section along the extension of portion 8*b*. It is essential that in the area of the circular arc the bottle holders are positioned opposite to the spray nozzles 15*b*.

As shown in FIG. 3, the upper portion 8*b* of the spiral winding is configured as a circular arc. It is also possible that the lower or lateral portion 8*a* of the spiral winding is configured as a 150-200° circular arc, which is advantageous when the bottles are filled with cleaning liquid. The nozzles 15*b* can be supplied—through elongated holes provided in the hollow shaft 30—with cleaning liquid in a selective way in desired segments via corresponding lines.

In the bottle cleaning machine according to the disclosure a plurality of nozzle wheels 16 are arranged one after the other in transportation direction T (see FIG. 2). Several assemblies of outer spraying nozzles 15*a* are also arranged one after the other in direction T. The cleaning liquid which is running from the nozzles and from the bottles downwards is collected in corresponding collecting tubs 17 separated from one another and can be supplied again via a pump 18 and a filter 19 via a corresponding line 25 to the nozzles of a cleaning section, which is positioned in the area of the collecting tub 17, or also to the cleaning nozzles of another section that are positioned above another collecting tub 17. The dimensions of the tubs 17 are matched to the number of the spirals in the respective cleaning section.

The common housing 12 comprises inspection windows 21, thereby permitting access to the components in the various cleaning sections.

Hence, the bottle washing machine comprises any desired number of spiral windings of the transportation path with corresponding spraying nozzles, as well as an inlet and outlet device. The inlet device is a bottle lowering star 1 (see FIG. 2) via which the bottles 5 enter into the bottle holders, here the bottle baskets 6. With a closing mechanism 2 the bottle holders, here the baskets 6, can be closed, so that the bottles can be moved overhead. The chain return line 4 is here positioned in a tub 3, which also comprises elements for guiding the chain 7. The tub 3 has provided therein a plurality of spraying nozzles 14 for carrying out the presoaking process. The chain 7 is running out of the tub 3 via a lower spiral bow 8*a* into the housing 12 and then passes through the number of spiral windings of the transportation path 8. At the end of the spiral transportation path the chain 7 is running via an outlet bow 9 out of the housing 12. With an opening mechanism 23, the bottle holders, here: the baskets 6, are reopened, and with a bottle lifting star 11 the bottles 5 are pushed out of the baskets 6 and discharged in cleaned form via an outlet start 13.

Figure 5:
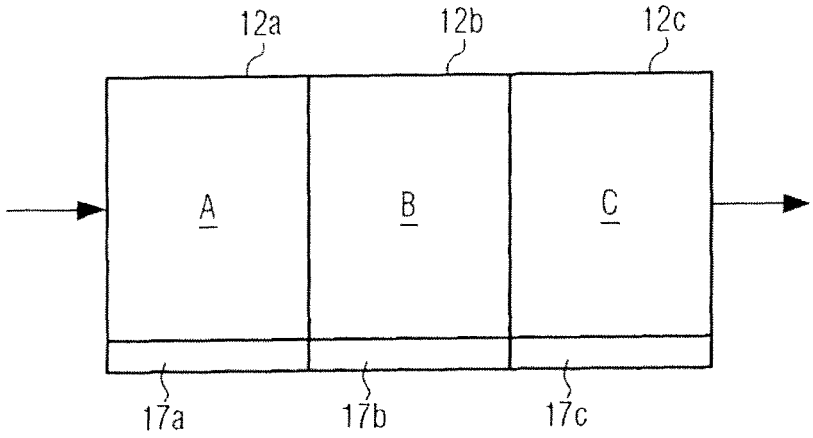
FIG. 5 is a schematic view showing a plurality of individual modules A, B, C composed to form a bottle cleaning machine.

Advantageously, the bottle cleaning machine, as follows particularly from FIG. 5, is of a modular type. The bottle cleaning machine 10 in FIG. 5 comprises e.g. three modules A, B, C. Each individual module comprises a spiral bottle transporting device, spraying nozzles 15*a, b*, and at least one collecting tub 17, as well as a corresponding housing section (without front and rear cover) 12*a, b, c*. The individual modules are here composed to form a whole bottle cleaning machine and are closed at the front and rear end preferably with a cover. Since identical subassemblies are used in all cleaning sections, the housing can be divided into standard transportation sizes, whereby the machine can be produced at low costs. With the standard modules A, B, C, the machine can be configured according to performance demands and cleaning requirements. For instance, to enhance the cleaning performance in the machine shown in FIG. 5 an additional module B can be used.

It is advantageous when the bottle cleaning machine further comprises a device (not shown) for generating a cleaned air current in the housing from the clean side to the dirt side, i.e. in a direction opposite to the arrow T in FIG. 2. An air flow introduced e.g. via Hepa filters can counteract bacterial dissemination.

In the method according to the disclosure the contaminated bottles 5 are here running via the bottle lowering star 1 into the grated bottle baskets 6, which are connected to one another to form the room-traveling chain 7. With the closing mechanism 3 the baskets 6 are closed, so that the bottles can be moved overhead and the mouthpiece of the bottle is also centered in the middle. The bottles pass through the tub 3 and can be sprayed for presoaking purposes, as shown in FIG. 1, via spraying nozzles 14. The liquid in the tub can be circulated again to the spraying nozzles 14, e.g. via a pump and a filter. The chain is then running via the lower spiral bow 8*a* into the housing 12, thereby passing through a number of spiral windings, preferably 24 to 48 spiral windings. All spiral windings are located in the common housing 12 with the further components. The bottles 5 are running through a plurality of cleaning sections (e.g. emptying, cleaning, rinsing). In the first two spiral windings 8, a high-pressure pre-spraying operation and a residue evacuating operation are e.g. carried out. To this end preferably spraying nozzles are arranged outside the spiral transportation path. In further spiral windings provided in transportation direction T the bottles 5 are cleaned with further stationary nozzles 15*a* from the outside and via the nozzles 15*b* on the nozzle wheels 16 from the inside.

The subsequent cleaning steps, clear and fresh-water rinsing, are carried out in the same way, with the intensity of standard rinsers. Fresh-water rinsing can even be intensified by hot steam treatment.

Figure 6:
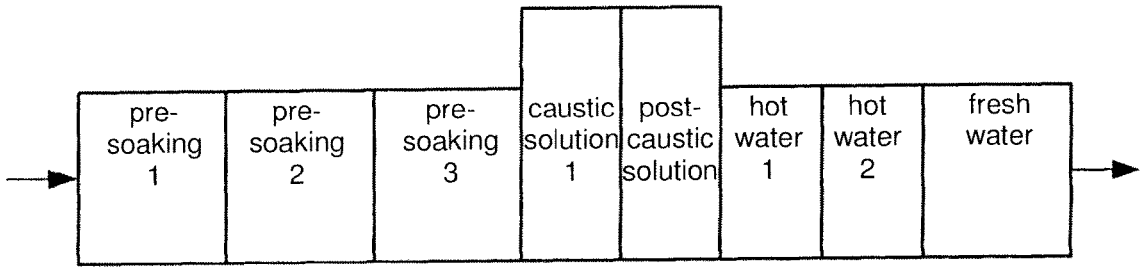
FIG. 6 PRIOR ART
FIG. 6 schematically shows the different stations of a bottle cleaning machine according to the prior art.

The cleaning liquids and water, respectively, are collected via the tubs 17*a, b, c* and are again passed via corresponding pumps 18 and filters 19 for the cleaning liquid to a desired treatment section. The logic for distribution and preparation is one employed for conventional bottle cleaning machines (see also FIG. 6). At the end of the housing, the bottles 5, i.e. the chain 7, leave the housing 12 again via an outlet guide bow 9. With an opening mechanism 10 the baskets are opened again and the bottles are pushed out of the baskets with a bottle lifting star 11 and are discharged via an outlet star 13.

An essential advantage lies in the smaller amount of cleaning liquid, so that e.g. temperature and soiling degree can be regulated more easily and the portion of the chemical cleaning additives can be minimized. Sediment formation is not possible and label discharge can be supported by way of high-pressure injection. Lump formation of the labels is thereby ruled out. Water with the commercially available chemical additives is used as the cleaning liquid. Rinsing is carried out with temperature-controlled fresh-water. The cleaning liquids can be brought to the corresponding temperature level via instantaneous water heaters or heat exchangers (not shown) in various sections. This entails the advantage that no large caustic volumes have to be kept at a specific temperature.

I claim:

1. A bottle cleaning machine, comprising a bottle transporting device for transporting the bottles to be cleaned comprising bottle holders, a corresponding guide, and a drive, spraying nozzles and the bottle transporting device being configured such that the bottles are transported past the spraying nozzles along a substantially spiral transportation path about one horizontal central axis, wherein at least in one spiral winding of the transportation path a portion is configured as a 150° to 200° circular arc, wherein in said 150° to 200° circular arc bottle holders are positioned opposite to the spraying nozzles which are arranged inside said spiral transportation path.

2. The bottle cleaning machine according to claim 1, wherein the bottle cleaning machine comprises a housing with at least one collecting tub.

3. The bottle cleaning machine according to claim 1, wherein the spraying nozzles are arranged to be stationary.

4. The bottle cleaning machine according to claim 1, wherein the spraying nozzles arranged within the transportation path are rotatingly arranged.

5. The bottle cleaning machine according to claim 1, wherein a tub through which the bottles are transported is arranged in front of the spiral transportation path.

6. The bottle cleaning machine according to claim 1, wherein the bottles are transported in bottle holders which are connected to one another to form a room-traveling chain.

7. The bottle cleaning machine according to claim 2, the bottle cleaning machine further comprising an air filter in the housing between a clean side where bottles enter the housing to a dirt side where bottles exit the housing.

8. The bottle cleaning machine according to claim 1, wherein the bottle cleaning machine has a modular structure consisting of a plurality of individual modules, each individual module comprising a spiral bottle transporting device, spraying nozzles and at least one collecting tub.

9. The bottle cleaning machine according to claim 8, wherein in an assembled state the collecting tubs are configured to be separated from one another.

10. The bottle cleaning machine according to claim 8, wherein a cleaning liquid from the at least one collecting tub is supplied to spraying nozzles via a filter and a pump.

11. The bottle cleaning machine according to claim 4, wherein the spraying nozzles are rotatingly arranged on a nozzle wheel.

12. The bottle cleaning machine according to claim 6, wherein the bottle holders are grated bottle baskets.

13. The bottle cleaning machine according to claim 1, and wherein a cleaning liquid is one of pulsed, has compressed air added thereto, or a combination thereof.

* * * * *